US006056593A

United States Patent [19]

Strang et al.

[11] Patent Number: 6,056,593

[45] Date of Patent: May 2, 2000

[54] ELECTRICAL RECEPTACLE ASSEMBLY HAVING HOUSING HELD TOGETHER BY FRONT MOUNTING BRIDGE

[75] Inventors: Ward E. Strang, Fairfield; Carol A. Howard, Oxford, both of Conn.

[73] Assignee: Hubbell Incorporated, Orange, Conn.

[21] Appl. No.: 08/827,333

[22] Filed: Mar. 26, 1997

[51] Int. Cl.[7] ..... H01R 13/66

[52] U.S. Cl. ..... 439/536

[58] Field of Search ..... 439/536, 557, 439/533, 553, 576

[56] References Cited

U.S. PATENT DOCUMENTS

| | | | |
|---|---|---|---|
| 1,882,080 | 10/1932 | Hubbell | 439/539 |
| 3,310,770 | 3/1967 | Ramsing | 339/14 |
| 3,688,239 | 8/1972 | Jaconette | 439/97 |
| 4,375,307 | 3/1983 | Rock | 439/107 |
| 5,484,309 | 1/1996 | Howard et al. | 439/539 |

*Primary Examiner*—Steven L. Stephan
*Assistant Examiner*—Eugene G. Byrd
*Attorney, Agent, or Firm*—Jerry M. Presson; Michael R. Swartz

[57] ABSTRACT

An electrical receptacle assembly includes a housing and a mounting bridge. The housing includes front and back covers adapted to mate together. The front cover has opposite forward and rearward sides and opposite top and bottom ends, and the back cover has opposite forward and rearward sides and top and bottom ends. The forward side of the front cover is a wall covering the same whereas the rearward side of the front cover is open. The forward side of the back cover is open whereas the rearward side of the back cover is a wall covering the same. The open forward side of the back cover is adapted to interfit with the open rearward side of front cover to provide them in a mated relationship with one another. The mounting bridge includes a body portion annular in shape having upper and lower ends and being adapted to fit over the front cover of the housing from the forward side and rearwardly to a position located intermediately between the forward and rearward sides of the front cover at which the annular body portion surrounds the front cover. The mounting bridge also includes a pair of upper and lower flange portions attached to and extending rearwardly from respective upper and lower ends of the body portion. The assembly also includes securement elements defined on the upper and lower flange portions of the mounting bridge and top and bottom ends of the front and back covers of the housing for releasably securing the upper and lower flange portions of the mounting bridge respectively to the top and bottom ends of the front and back covers of the housing with the front and back covers in the mated relationship with one another.

20 Claims, 4 Drawing Sheets

ELECTRICAL RECEPTACLE ASSEMBLY HAVING HOUSING HELD TOGETHER BY FRONT MOUNTING BRIDGE

CROSS REFERENCE TO RELATED APPLICATION

Reference is hereby made to the following U.S. application dealing with subject matter related to the present invention: "Electrical Receptacle Assembly With Interference Fitting And Latching Parts" by Carol A. Howard et al, assigned U.S. Ser. No. 08/331,981 and filed Oct. 31, 1994, now U.S. Pat. No. 5,484,309 which issued Jan. 16, 1996.

BACKGROUND OF THE INVENTION

1. Field of the Invention

The present invention generally relates to electrical equipment and, more particularly, is concerned with an electrical receptacle assembly employing a housing held together by a front mounting bridge.

2. Description of the Prior Art

Heretofore, electrical receptacles manufactured and marketed by Hubbell Incorporated of Orange, Conn., the assignee of the subject application, have employed a generally rectangular housing assembly. The housing assembly includes a housing formed by separate matable front and back covers and a generally U-shaped "wrap-around" mounting bridge. The bridge has a base portion positioned adjacent the rear side of the housing and a pair of opposite upper and lower leg portions extending vertically therealong and forwardly therefrom along top and bottom ends of the housing.

Traditionally, the mounting bridge at the back cover of the housing has been attached to the rear side of the housing. The mounting bridge is also provided with upper and lower mounting tabs attached to and extending respectively upwardly and downwardly from front ends of opposite upper and lower leg portions of the mounting bridge. The upper and lower mounting tabs have eyelets defined therethrough for fastening the bridge to a receptacle or outlet box, which is attached to a building wall, by the use of screws inserted through the upper and lower eyelets and threaded into the box.

More recently, as disclosed in the cross-reference application, the upper and lower leg portions of the mounting bridge and the top and bottom ends of the front and back covers of the housing have incorporated elements for securing the mated front and back covers together. The securement elements take the form of wedge shaped ramps on the front and back covers and openings in the upper and lower leg portions of the mounting bridge. These securement elements enable the mounting bridge to be applied to the housing to hold the front and rear covers of the housing together in a mated relationship without the use of tools. This represented a significant innovation among various techniques for assembling the parts of electrical receptacle housings together. The inventors herein have perceived a need to provide even further innovation with respect to the assembling of the parts of electrical receptacle housings together.

SUMMARY OF THE INVENTION

The present invention provides an electrical receptacle assembly designed to satisfy the aforementioned needs. The electrical receptacle assembly of the present invention has a housing held together by a front mounting bridge which permits easy attachment of the bridge to the housing and assures rapid assembling because no mechanical fasteners, such as screws or rivets, are used. Also, assembly and disassembly are achieved without the use of any tools. The elimination of separate mechanical fasteners from the assembly allows for a more compact electrical assembly unit since no bosses for screw mounting holes are required in the housing. Further, with this design, the front and back covers of the housing can be adhesively bonded or ultrasonically welded to ensure water-tightness, or they can be secured by means of the bridge alone.

Accordingly, the present invention is directed to an electrical receptacle assembly which comprises: (a) a housing including (i) a front cover having opposite forward and rearward sides and opposite top and bottom ends, and (ii) a back cover having opposite forward and rearward sides and top and bottom ends, the back cover at the forward side thereof being adapted to interfit with the front cover at the rearward side thereof to provide the front and back covers in a mated relationship with one another and define an interior cavity; (b) a mounting bridge including (i) a body portion annular in shape and adapted to fit over the front cover of the housing from the forward side thereto rearwardly to a position located intermediately between the forward and rearward sides of the front cover at which the body surrounds the front cover, the body portion having upper and lower ends, and (ii) a pair of upper and lower flange portions attached to and extending rearwardly from respective upper and lower ends of the body portion; and (c) means for releasably securing the upper and lower flange portions of the mounting bridge respectively to the top and bottom ends of the front and back covers of the housing with the front and back covers in the mated relationship with one another. The releasable securing means includes a pair of first securement elements each defined on one of the top and bottom ends of the front cover, a pair of second securement elements each defined on one of the top and bottom ends of the back cover, each of the second securement elements forming a continuation of a respective one of the first securement elements with the front and back covers in the mated relationship, a third securement element defined on the upper flange portion of the mounting bridge such that with the front and back covers in the mated relationship the third securement element interfits and releasably latches with the first and second securement elements on the top end of the front and back covers, and a fourth securement element defined on the lower flange portion of the mounting bridge such that with the front and back covers in the mated relationship the fourth securement element interfits and releasably latches with the first and second securement elements on the bottom end of the front and back covers.

More particularly, the first securement elements are guide ramps raised in a rearwardly and outwardly inclined relationship from exterior surfaces of the top and bottom ends of the front cover, each guide ramp having a front lip facing in a forward direction. The second securement elements are guide bosses raised from exterior surfaces of the top and bottom ends of the back cover such that with the front and back covers mated together the guide bosses form continuations of the guide ramps, each guide boss having an undercut rear portion facing in a rearward direction. Each of the third and fourth securement elements includes a slot formed therein having a size adapted to receive a pair of guide ramp and boss therethrough in a nested relationship with the front and back covers of the housing in the mated relationship and inserted between the upper and lower flange portions of the mounting bridge, each of the upper and lower flange portions in the nested relationship with a respective one of the slots having an edge extending about the undercut rear portion of a respective one of the guide bosses. The third and fourth securement elements also include latching ledges extending respectively below and above lower and upper ends of the body portion of the mounting bridge, the latching ledges adapted to engage the front lips on the guide ramps on the top and bottom ends of the front cover of the housing.

The electrical receptacle assembly further includes means on one of the top and bottom ends of the front cover and one of the upper and lower ends of the body portion of the mounting bridge for orienting the mounting bridge relative to the housing so as to ensure that the housing and the mounting bridge are assembled together with a correct vertical orientation. More particularly, the orienting means includes an alignment slot defined in the latching ledge on one of the upper and lower ends of the body portion of the mounting bridge and an alignment protuberance insertable within the alignment slot and being defined on and projecting forwardly from the guide ramp on one of the top and bottom ends of the front cover corresponding to the one of the upper and lower ends of the body portion of said mounting bridge.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
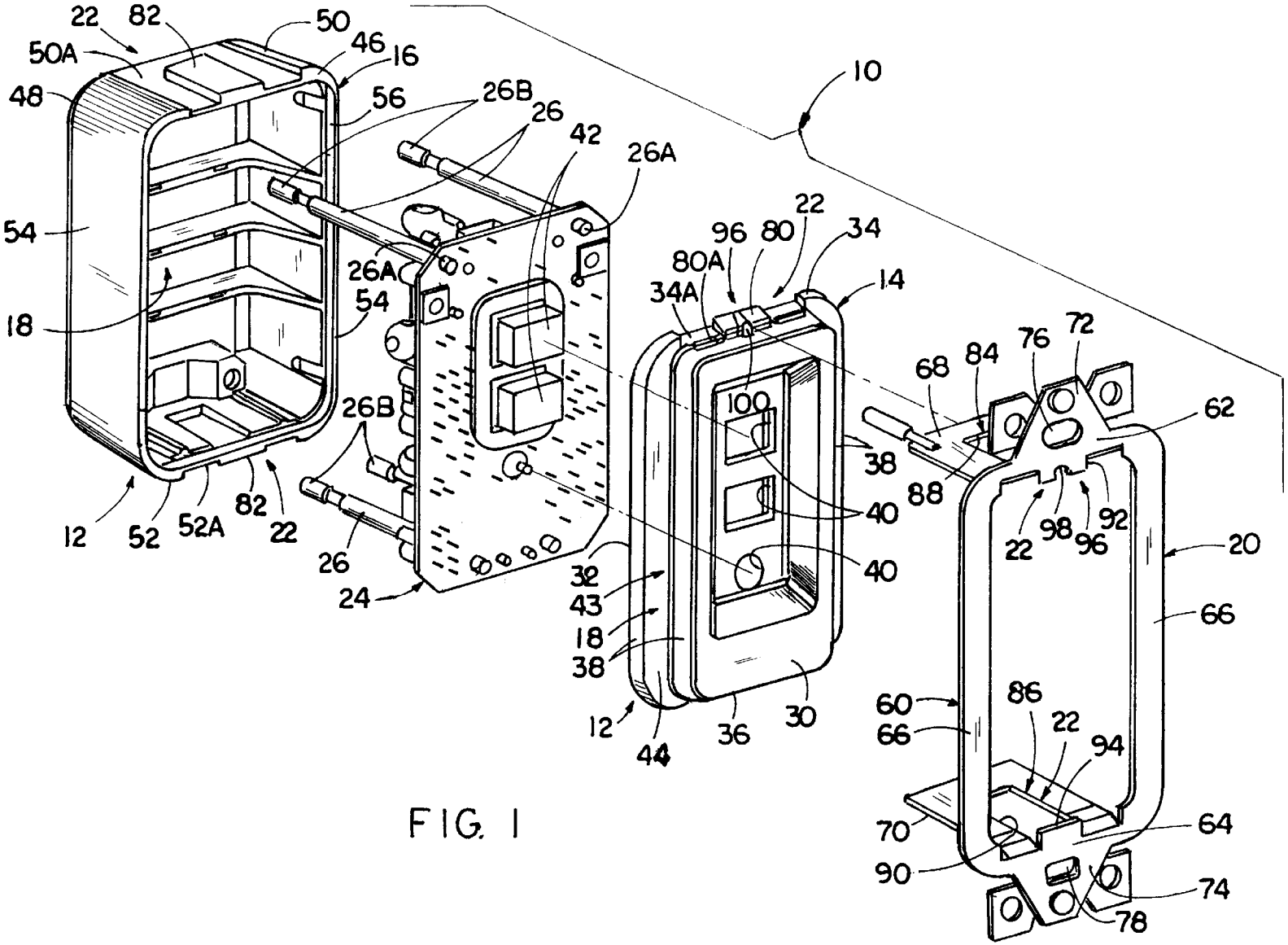
FIG. 1 is an exploded perspective view of an electrical receptacle assembly of the present invention

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 2:
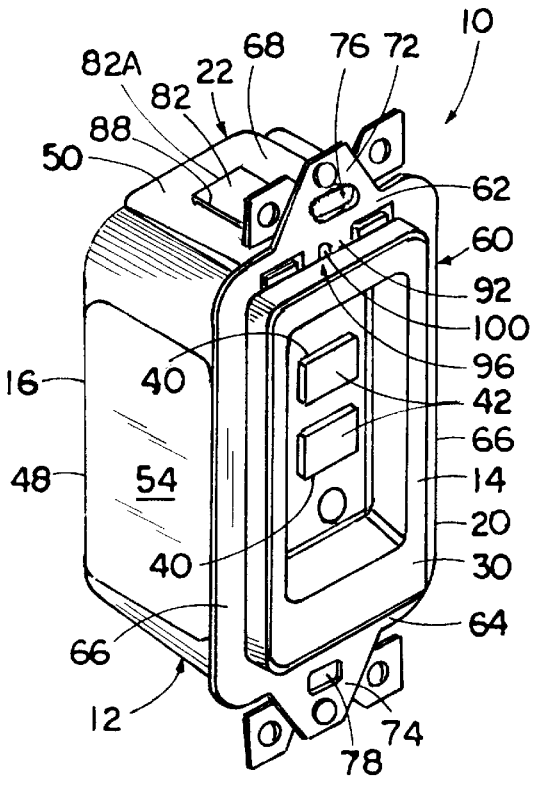
FIG. 2 is an assembled perspective view of the assembly of FIG. 1.
Figure 3:
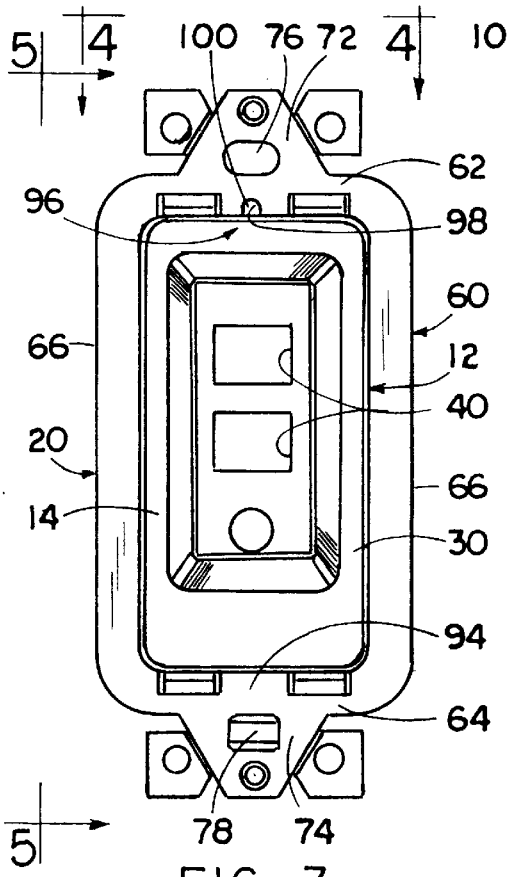
FIG. 3 is a front elevational view of the assembly of FIG. 2.
Figure 4:
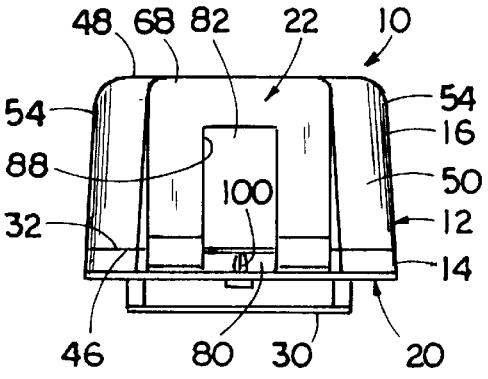
FIG. 4 is a top plan view of the assembly as seen along line 4—4 of FIG. 3.
Figure 5:
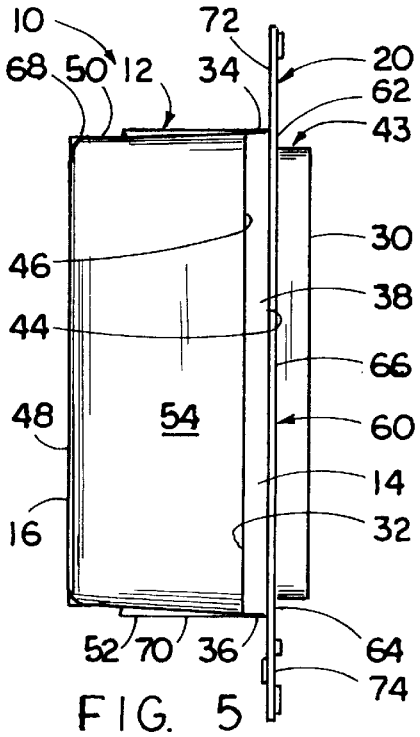
FIG. 5 is a side elevational view of the assembly of FIG. 3 as seen along line 5—5 of FIG. 3.

Referring now to the drawings, and particularly to FIGS. 1–5, there is illustrated an electrical receptacle assembly of the present invention, generally designated 10. The principles of the present invention employed by the electrical receptacle assembly 10 can be used in electrical receptacles for various applications. The application illustrated in the drawings is an electrical receptacle for a ground fault circuit interrupt unit or the like. The electrical receptacle assembly 10 basically includes a two-piece housing 12 having a front cover 14 and a back cover 16. The back cover 16 is separate from and matable with the front cover 14. When the front and back covers 14, 16 are disposed in a mated relationship with one another as seen in FIGS. 2–5, the housing 12 has a substantially rectangular shape, although other shapes are equally possible, and encloses an interior cavity 18. The assembly 10 also includes a mounting bridge 20 and securing means 22 employed to hold the front and back covers 14, 16 together in the mated relationship by securing the mounting bridge 20 to the housing 12. The assembly 10 further includes a circuitboard 24 disposed in the interior cavity 18 of the housing 12 and a plurality of connector wires 26 each being connected at one end 26A to the circuitboard 24 and with their respective opposite ends 26B being suitably connected by wire nuts (not shown) or the like to a power source lead (not shown).

Figure 7:
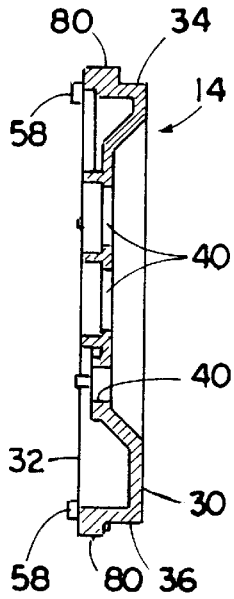
FIG. 7 is a longitudinal sectional view of the front cover taken along line 7—7 of FIG. 6.
Figure 6:
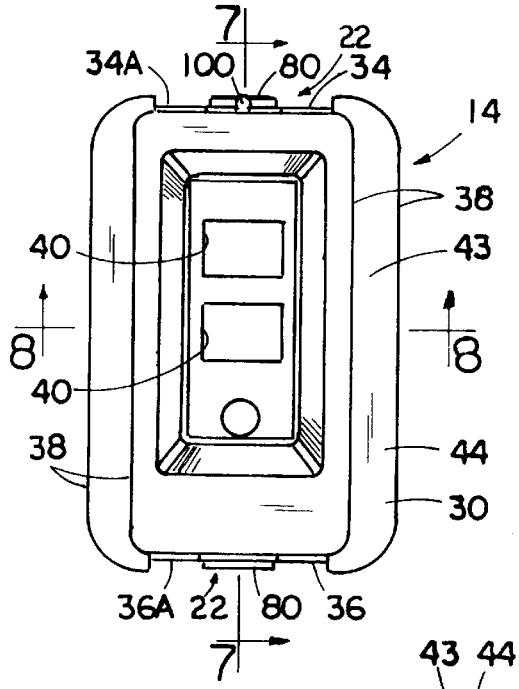
FIG. 6 is a front elevational view of a front cover of the housing of the assembly of FIGS. 1 and 2.
Figure 8:
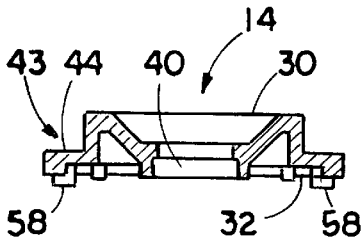
FIG. 8 is a cross-sectional view of the front cover taken along line 8—8 of FIG. 6.

Referring to FIGS. 1–8, the front cover 14 of the housing 12 has opposite forward and rearward sides 30, 32, opposite top and bottom ends 34, 36 and opposite lateral sides 38 all of which are integrally connected together. The forward side 30 of the front cover 14 is a wall substantially closing the same and having openings 40 for receiving elements such as pushkeys 42 mounted on the circuitboard 24 disposed in the interior cavity 18. On the other hand, the rearward side 32 of the front cover 14 is open. The front cover 14 also has an exterior recess 43 formed in and extending at least partially around the top and bottom ends 34, 36 and the lateral sides 38 thereof which, in turn, forms a flat annular shoulder 44 facing in the forward direction and at least partially surrounds the front cover 14 at an intermediate location between its forward and rearward sides 30, 32.

Figure 12:
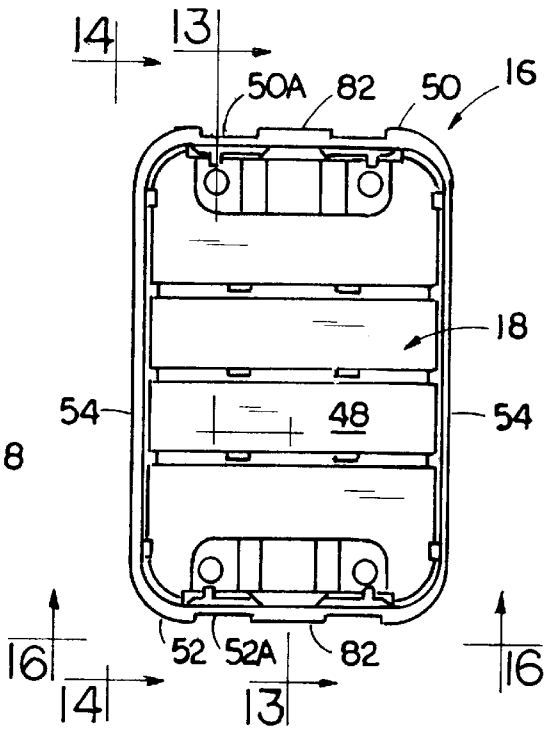
FIG. 12 is a front elevational view of a back cover of the housing of the assembly of FIGS. 1 and 2.
Figure 13:
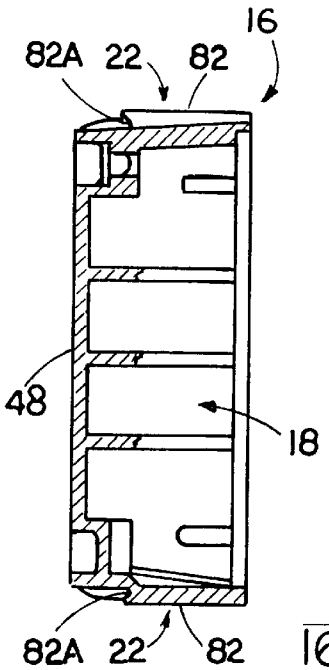
FIG. 13 is a longitudinal sectional view of the back cover taken along line 13—13 of FIG. 12.
Figure 14:
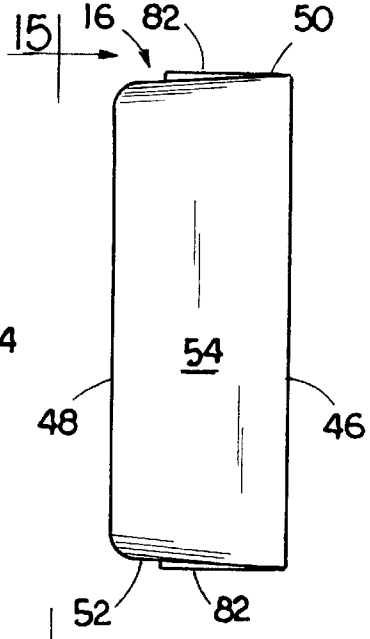
FIG. 14 is a side elevational view of the back cover as seen along line 14—14 of FIG. 12.
Figure 15:
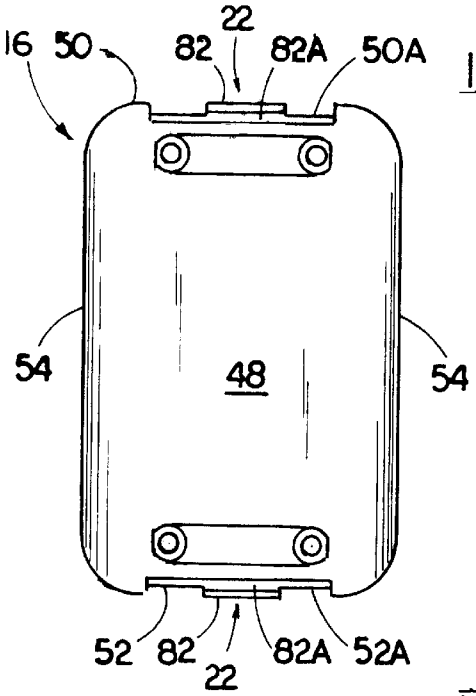
FIG. 15 is a rear elevational view of the back cover as seen along line 15—15 of FIG. 14.
Figure 16:
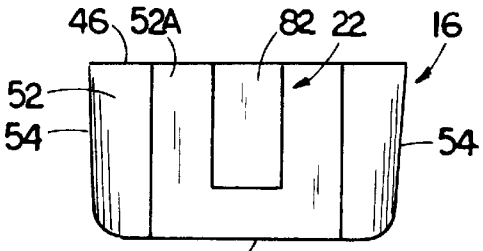
FIG. 16 is a top plan view of the back cover as seen along line 16—16 of FIG. 12.

Referring to FIGS. 1–5 and 12–16, the back cover 16 of the housing 12 has opposite forward and rearward sides 46, 48, top and bottom ends 50, 52 and opposite lateral sides 54 all of which are integrally connected together. The forward side 46 of the back cover 16 is open whereas the rearward side 48 of the back cover 16 is a wall substantially closing the same. The open forward side 46 of the back cover 16 is adapted to interfit with the open rearward side 32 of front cover 14 to provide them in the mated relationship with one another. The back cover 16 has an interior recess 56 formed in and extending along the front periphery of the top and bottom ends 50, 52 and the opposite lateral sides 54 which define the open forward side 46 of the back cover 16. The front cover 14 has circumferentially spaced mating tabs 58 attached to and projecting rearwardly from the open rearward side 48 of the front cover 14 which can interfit within the peripheral interior recess 56 at the open forward side 46 of the back cover 16. Due to the presence of the respective peripheral interior recess 56 and mating tabs 58, the back cover 16 at its forward side 46 is matable with and unmatable from the front cover 14 at its rearward side 32.

Figure 10:
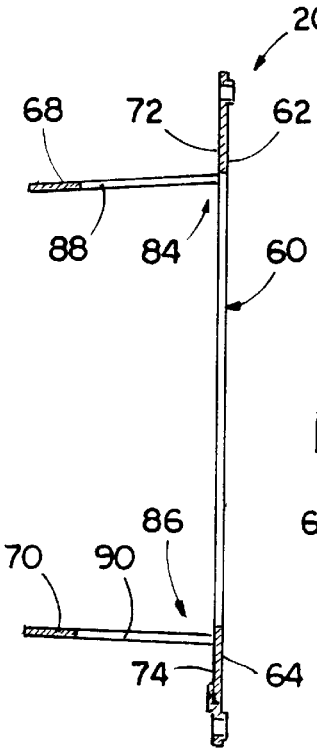
FIG. 10 is a longitudinal sectional view of the mounting bridge taken along line 10—10 of FIG. 9.
Figure 9:
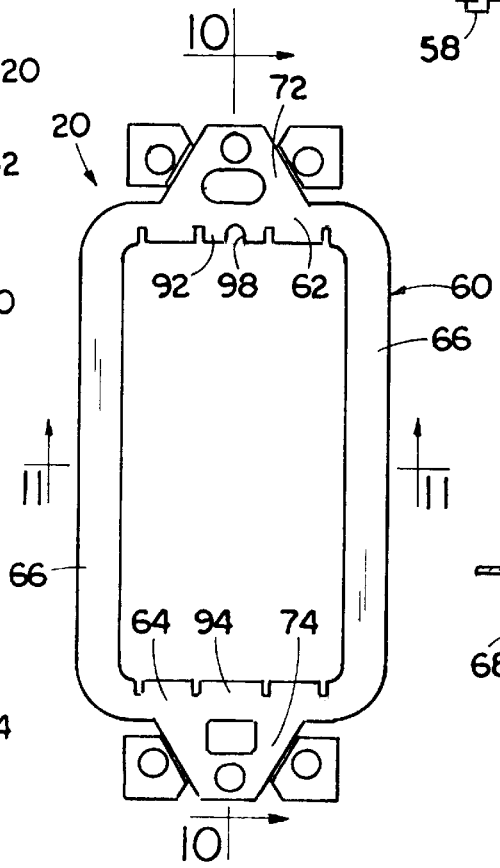
FIG. 9 is a front elevational view of a mounting bridge of the assembly of FIGS. 1 and 2.
Figure 11:
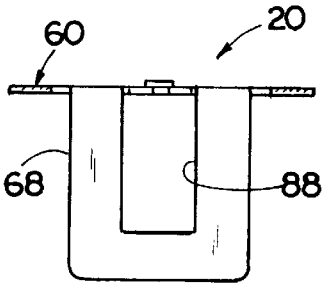
FIG. 11 is a cross-sectional view of the mounting bridge taken along line 11—11 of FIG. 9.

Referring to FIGS. 1–5 and 9–11, the mounting bridge 20 includes a body portion 60 having an annular shape defined by opposite upper and lower ends 62, 64 and opposite sides 66 extending between and integrally interconnecting the opposite upper and lower ends 62, 64. The upper and lower ends 62, 64 and opposite sides 66 preferably, although not necessarily, all lie substantially flat in a common plane. The annular body portion 60 is of a size relative to the front cover 14 as to be fittable thereover from the forward side 30 thereof and moved rearwardly to a position located intermediately between the forward and rearward sides 30, 32 of the front cover 14 and against the annular shoulder 44 defined at least partially around the front cover 14. In such position, the annular body portion 60 of the mounting bridge 20 substantially surrounds the front cover 14.

The mounting bridge 20 also includes a pair of upper and lower flange portions 68, 70 attached to and extending rearwardly from respective upper and lower ends 62, 64 of the body portion 60 of the mounting bridge 20. The rearwardly extending upper and lower flange portions 68, 70, which are substantially parallel to or slightly inclined toward one another, will respectively overlie the top and bottom ends 34, 36 and 50, 52 of the mated front and back covers 14, 16 of the housing 12.

Further, the mounting bridge 20 has upper and lower mounting tabs 72, 74 attached to and extending respectively upwardly and downwardly from the upper and lower ends 62, 64 of the body portion 60 of the mounting bridge 20. The upper and lower mounting tabs 72, 74 have conventional respective mounting openings 76, 78 defined therethrough for fastening the mounting bridge 20 and therewith the assembled housing 12 to a suitable structure by the use of screws (not shown) inserted through the upper and lower mounting openings 76, 78. Thus, it is readily seen that the mounting bridge 20 has a dual purpose or function, such being to hold the front and back covers 14, 16 of the housing 12 mated together and to mount the assembled housing 12 to the support structure.

Referring to FIGS. 1, 2, 4–7 and 10–16, the securing means 20 of the assembly 10 includes a pair of first securement elements 80 respectively defined on the top and bottom ends 34, 36 of the front cover 14 of the housing 12, and a pair of second securement elements 82 respectively defined on the top and bottom ends 50, 52 of the back cover 16 of the housing 12. The securing means 20 also includes third and fourth securement elements 84, 86 defined by the respective upper and lower flange portions 68, 70 of the mounting bridge 20. The securing means 20 releasably secure the upper and lower flange portions 68, 70 of the mounting bridge 20 respectively to the top and bottom ends 34, 36 and 50, 52 of the front and back covers 14, 16 of the housing 12 after the front and back covers 14, 16 are placed in the mated relationship with one another.

In the exemplary form shown in the drawings, the first securement elements 80 which are defined on the respective top and bottom ends 34, 36 of the front cover 14 of the housing 12 each takes the form of a guide ramp 80 raised in a rearwardly and outwardly inclined relationship from the exterior surface 34A, 36A of the top and bottom ends 34, 36 of the front cover 14, whereas the second securement elements 82 which are defined on the respective top and bottom ends 50, 52 of the back cover 14 of the housing 12 each takes the form of a guide boss 82 raised from the exterior surfaces 50A, 52A of the top and bottom ends 50, 52 of the back cover 16. Each guide boss 82 has an undercut rear portion 82A facing in a rearward direction, whereas each guide ramp 80 has a front lip 80A facing in a forward direction. When the front and back covers 14, 16 are mated together, the guide bosses 82 form continuations of the guide ramps 80.

Further, in the exemplary form shown in the drawings, the third and fourth securement elements 84, 86 which are defined respectively on the opposite upper and lower flange portions 68, 70 of the mounting bridge 20 each takes the form of a slot 88, 90 and a latching ledge 92, 94 extending below and above the lower and upper ends 64, 62 of the body portion 60 of the mounting bridge 20. The slots 88, 90 have respective sizes adapted to receive the guide ramps and bosses 80, 82 therethrough in a nested relationship when the mated front and back covers 14, 16 of the assembled housing 12 is inserted between the upper and lower flange portions 68, 70 of the mounting bridge 20. The latching ledges 92, 94 are adapted to engage the front lips 80A on the guide ramps 80 when the assembled housing 12 is fully inserted between the upper and lower flange portions 68, 70 of the bridge 20 and the guide ramps and bosses 80, 82 are nested within the slots 88, 90 thereof.

The front and back covers 14, 16 are preferably fabricated as rigid structures molded from a suitable plastic, whereas the mounting bridge 20 is fabricated of a substantially rigid but slightly bendable metal to allow the upper and lower flange portions 68, 70 to be temporarily forced away from one another. To assemble the mounting bridge 20 to the front and back covers 14, 16, the upper and lower flanges portions 68, 70 of the mounting bridge 20 engage the guide ramps 80 on the front cover 14 and are forced slightly away from one another so as to allow the upper and lower flange portions 68, 70 to easily slide over ramps and bosses 80, 82 on the top and bottom ends 34, 36 and 50, 52 of the mated front and back covers 14, 16 of the housing 12 as the latter becomes fitted therebetween. Once the rear edges of the upper and lower flange portions 68, 70 at the rear of the slots 88, 90 therein have moved rearwardly past the undercut rear portions 82A of the guide bosses 82 on the back cover 16, the guide bosses 82 will nest within the slots 88, 90 and an interference-fitted latched connection is obtained between the upper and lower flange portions 68, 70 and the top and bottom ends 34, 36 and 50, 52 of the mated front and back covers 14, 16 of the housing 12 so as to thereby secure the assembled housing 12 between the upper and lower flange portions 68, 70 of the mounting bridge 20. By again slightly forcing apart from one another the upper and lower flange portions 68, 70 of the mounting bridge 20, the housing 12 can be uncoupled from the mounting bridge 20.

Referring to FIGS. 1–4, 6, 7 and 9, the assembly 10 also includes orienting means 96 incorporated by the front cover 14 and the mounting bridge 20 of the assembly for orienting the mounting bridge 20 relative to the housing 12 so as to ensure that the housing 12 and bridge 20 are assembled together with the correct vertical orientation. In the exemplary form shown in the drawings, the orienting means 96 takes the form of an alignment slot 98 defined centrally in the upper latching ledge 92 upwardly from a bottom edge 92A thereof and an alignment protuberance 100 defined centrally on and projecting forwardly from the upper guide ramp 80 on the top end 34 of the front cover 14. Unless the mounting bridge 20 is oriented relative to the front cover 14 so that the alignment protuberance 100 is aligned with the alignment slot 98 the mounting bridge 20 cannot be installed over the front cover 14. It can be easily understood that, as an alternative arrangement, the alignment slot and protuberance 98, 100 can be defined on the lower latching ledge 94 and lower guide ramp 80.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. An electrical receptacle assembly, comprising:

(a) a housing including (i) a front cover having opposite forward and rearward sides and opposite top and bottom ends with respective outside surfaces, and (ii) a back cover having opposite forward and rearward sides and top and bottom ends with respective outside surfaces, said back cover at said forward side thereof being adapted to interfit with said front cover at said rearward side thereof to provide said front and back covers in a mated relationship with one another and define an interior cavity;

(b) a mounting bridge including (i) a body portion annular in shape and adapted to fit over said front cover of said housing from said forward side thereof so as to surround said front cover, said body portion having upper and lower ends, and (ii) a pair of upper and lower flange portions attached to and extending rearwardly from respective upper and lower ends of said body portion, said upper and lower flange portions extending respectively along said outside surfaces of said top and bottom ends of said front and back covers of said housing with said front and back covers in said mated relationship with one another; and (c) means on said outside surfaces of said top and bottom ends of said front and back covers for releasably securing said upper and lower flange portions of said mounting bridge respectively to said top and bottom ends of said front and back covers of said housing with said front and back covers in said mated relationship with one another.

2. The assembly as recited in claim 1, wherein said mounting bridge also includes upper and lower mounting tabs respectively connected to and extending above and below said upper and lower ends of said body portion of said mounting bridge, said upper and lower mounting tabs having respective means for facilitating the fastening of said mounting bridge to a support structure.

3. The assembly as recited in claim 1, wherein said securing means includes:

a pair of first securement elements each defined on one of said top and bottom ends of said front cover;

a pair of second securement elements each defined on one of said top and bottom ends of said back cover, each of said second securement elements forming a continuation of a respective one of said first securement elements with said front and back covers in said mated relationship.

4. The assembly as recited in claim 3, wherein said first securement elements defined on said respective top and bottom ends of said front cover are guide ramps raised in a rearwardly and outwardly inclined relationship from exterior surfaces of said top and bottom ends of said front cover.

5. The assembly as recited in claim 4, wherein each guide ramp has a front lip facing in a forward direction.

6. The assembly as recited in claim 3, wherein said second securement elements defined on said respective top and bottom ends of said back cover are guide bosses raised from exterior surfaces of said top and bottom ends of the back cover such that with said front and back covers mated together said guide bosses form continuations of said guide ramps.

7. The assembly as recited in claim 6, wherein each guide boss has an undercut rear portion facing in a rearward direction.

8. The assembly as recited in claim 3, wherein said securing means further includes:

a third securement element defined on said upper flange portion of said mounting bridge such that with said front and back covers in said mated relationship said third securement element interfits and releasably latches with said first and second securement elements on said top end of said front and back covers; and a fourth securement element defined on said lower flange portion of said mounting bridge such that with said front and back covers in said mated relationship said fourth securement element interfits and releasably latches with said first and second securement elements on said bottom end of said front and back covers.

9. The assembly as recited in claim 8, wherein said first securement elements defined on said respective top and bottom ends of said front cover are guide ramps raised in a rearwardly and outwardly inclined relationship from exterior surfaces of said top and bottom ends of said front cover.

10. The assembly as recited in claim 9, wherein said second securement elements defined on said respective top and bottom ends of said back cover are guide bosses raised from exterior surfaces of said top and bottom ends of the back cover such that with said front and back covers mated together said guide bosses form continuations of said guide ramps.

11. The assembly as recited in claim 10, wherein each of said third and fourth securement elements defined respectively on said upper and lower flange portions of said mounting bridge includes a slot formed therein having a size adapted to receive a pair of said guide ramp and boss therethrough in a nested relationship with said front and back covers of said housing in said mated relationship and inserted between said upper and lower flange portions of said mounting bridge.

12. The assembly as recited in claim 11, wherein each guide boss has an undercut rear portion facing in a rearward direction about which an edge of a respective one of said upper and lower flange portions of said mounting bridge extends in said nested relationship with said slots therein.

13. The assembly as recited in claim 9, wherein each guide ramp has a front lip facing in a forward direction.

14. The assembly as recited in claim 13, wherein said third and fourth securement elements defined respectively on said upper and lower flange portions of said mounting bridge include latching ledges extending respectively below and above lower and upper ends of said body portion of said mounting bridge, said latching ledges adapted to engage front lips on said guide ramps on said top and bottom ends of said front cover of said housing.

15. The assembly as recited in claim 1, further comprising:

means on one of said top and bottom ends of said front cover and one of said upper and lower ends of said body portion of said mounting bridge for orienting said mounting bridge relative to said housing so as to ensure that said housing and said mounting bridge are assembled together with a correct vertical orientation.

16. The assembly as recited in claim 15, wherein said orienting means includes:

an alignment slot defined in said one of said upper and lower ends of said body portion of said mounting bridge; and an alignment protuberance insertable within said alignment slot and being defined on and projecting forwardly from said one of said top and bottom ends of said front cover corresponding to said one of said upper and lower ends of said body portion of said mounting bridge.

17. An electrical receptacle assembly, comprising:

(a) a housing including (i) a front cover having opposite forward and rearward sides and opposite top and bottom ends with respective outside surfaces, and (ii) a back cover having opposite forward and rearward sides and top and bottom ends with outside surfaces, said back cover at said forward side thereof being adapted to interfit with said front cover at said rearward side thereof to provide said front and back covers in a mated relationship with one another;

(b) a mounting bridge including (i) a body portion annular in shape and adapted to fit over said front cover of said housing from said forward side thereto rearwardly to a position located intermediately between said forward and rearward sides of said front cover at which said body portion surrounds said front cover, said body portion having upper and lower ends, and (ii) a pair of upper and lower flange portions attached to and extending rearwardly from respective upper and lower ends of said body portion, said upper and lower flange portions extending respectively along said outside surfaces of said top and bottom ends of said front and back covers of said housing with said front and back covers in said mated relationship with one another; and (c) means on said outside surfaces of said top and bottom ends of said front and back covers for releasably securing said upper and lower flange portions of said mounting bridge respectively to said top and bottom ends of said front and back covers of said housing with said front and back covers in said mated relationship with one another, said securing means including (i) a pair of first securement elements each defined on one of said top and bottom ends of said front cover, (ii) a pair of second securement elements each defined on one of said top and bottom ends of said back cover, each of said second securement elements forming a continuation of a respective one of said first securement elements with said front and back covers in said mated relationship, (iii) a third securement element defined on said upper flange portion of said mounting bridge such that with said front and back covers in said mated relationship said third securement element interfits and releasably latches with said first and second securement elements on said top end of said front and back covers, and (iv) a fourth securement element defined on said lower flange portion of said mounting bridge such that with said front and back covers in said mated relationship said fourth securement element interfits and releasably latches with said first and second securement elements on said bottom end of said front and back covers.

18. The assembly as recited in claim 17, wherein:

said first securement elements defined on said respective top and bottom ends of said front cover are guide ramps raised in a rearwardly and outwardly inclined relationship from exterior surfaces of said top and bottom ends of said front cover, each guide ramp having a front lip facing in a forward direction;

said second securement elements defined on said respective top and bottom ends of said back cover are guide bosses raised from exterior surfaces of said top and bottom ends of the back cover such that with said front and back covers mated together said guide bosses form continuations of said guide ramps, each guide boss having an undercut rear portion facing in a rearward direction; and each of said third and fourth securement elements defined respectively on said upper and lower flange portions of said mounting bridge including a slot formed therein having a size adapted to receive a pair of said guide ramp and boss therethrough in a nested relationship with said front and back covers of said housing in said mated relationship and inserted between said upper and lower flange portions of said mounting bridge, each of said upper and lower flange portions in said nested relationship with a respective one of said slots having an edge extending about said undercut rear portion of a respective one of said guide bosses;

said third and fourth securement elements defined respectively on said upper and lower flange portions of said mounting bridge also including latching ledges extending respectively below and above lower and upper ends of said body portion of said mounting bridge, said latching ledges adapted to engage said front lips on said guide ramps on said top and bottom ends of said front cover of said housing.

19. The assembly as recited in claim 18, further comprising:

means on one of said top and bottom ends of said front cover and one of said upper and lower ends of said body portion of said mounting bridge for orienting said mounting bridge relative to said housing so as to ensure that said housing and said mounting bridge are assembled together with a correct vertical orientation.

20. The assembly as recited in claim 19, wherein said orienting means includes:

an alignment slot defined in said latching ledge on one of said upper and lower ends of said body portion of said mounting bridge; and an alignment protuberance insertable within said alignment slot and being defined on and projecting forwardly from said guide ramp on one of said top and bottom ends of said front cover corresponding to said one of said upper and lower ends of said body portion of said mounting bridge.

* * * * *